United States Patent [19]

Ehrlich

[11] 4,365,853

[45] Dec. 28, 1982

[54] ARTICLE FOR STORING AND DISPENSING DETERGENT COMPOSITIONS UTILIZING SEPARATE TABLETS OF COMPONENTS

[75] Inventor: Robert L. Ehrlich, Wyckoff, N.J.

[73] Assignee: Colgate-Palmolive Company, New York, N.Y.

[21] Appl. No.: 920,936

[22] Filed: Jun. 30, 1978

Related U.S. Application Data

[60] Division of Ser. No. 722,988, Sep. 13, 1976, Pat. No. 4,099,912, which is a continuation of Ser. No. 470,258, May 15, 1974, abandoned.

[51] Int. Cl.[3] ..... B65D 83/04

[52] U.S. Cl. ..... 312/42; 8/137

[58] Field of Search ..... 8/137; 221/92, 309; 68/17 R; 133/5 A, 5 B, 6; 312/42, 71

[56] References Cited

U.S. PATENT DOCUMENTS

| | | | |
|---|---|---|---|
| 1,289,748 | 12/1918 | Hart | 133/5 B |
| 1,385,382 | 7/1921 | McGill et al. | 133/5 B |
| 2,766,762 | 10/1956 | Gordon | 133/5 B |
| 3,178,915 | 4/1965 | Hertel | 68/17 R |
| 3,449,034 | 6/1969 | Holst et al. | 133/5 A |
| 3,826,113 | 7/1974 | Boraas et al. | 68/17 R |

*Primary Examiner*—Paul R. Michl

*Attorney, Agent, or Firm*—Richard N. Miller; Murray M. Grill; Herbert S. Sylvester

[57] ABSTRACT

An article for storing and dispensing a detergent composition in the form of separate units of at least two detergent composition components is disclosed which comprises a holder which holds 2 to 10 receptacles attached thereto by readily removable attaching means and contains means for fastening said holder to a washing machine or to a wall. Each receptacle has a filling opening at the top, retaining means at the bottom, viewing openings or a transparent section and openings in the side walls at the lower end through which units may be removed; is sized to hold units having a weight of 5–30 grams, a volume of 5–20 milliliters, and a density of 0.8 to 2 g./ml.; and contains only units of a single detergent composition component. Such a dispensing apparatus is designed to enable the housewife to formulate her own detergent composition based upon her own particular needs by dispensing, if needed, a plurality of units of each detergent composition component.

3 Claims, 4 Drawing Figures

ARTICLE FOR STORING AND DISPENSING DETERGENT COMPOSITIONS UTILIZING SEPARATE TABLETS OF COMPONENTS

This is a divisional of application Ser. No. 722,988 now U.S. Pat. No. 4,099,912 filed Sept. 13, 1976, which is a continuation of application Ser. No. 470,258 filed May 15, 1974, now abandoned.

This application relates to detergent compositions and components, packages containing them, articles for dispensing them and methods of utilizing them. More particularly, it relates to detergent compositions and detersive processes wherein there are employed separate units, such as tablets, of major detergent components, which tablets are easily formulated by the housewife or operator of an automatic washing machine so as to produce an efficient heavy duty, light duty or other specialized detersive medium for laundry to be washed. The invention may be adapted for the production of light duty or heavy duty liquid detergents, too.

Detergent compositions are known which contain different ingredients for effecting various functions in washing operations. Various built synthetic organic detergents contain synthetic anionic organic detergent, often with some nonionic detergent, builder salt, bleaching agent, anti-corrosion component, pH-adjusting salt, filler salt, anti-redeposition agent, foam supressor, bactericide, antioxidant and perfume. Each of these constituents lends its properties to the final product. The formulation described above is that of a particulate heavy duty synthetic organic detergent but other particulate detergents, have also been marketed, including some light duty detergents without builder salts. For ease of use such formulations are usually in spray dried bead form, sometimes necessitating the employment of fillers or carriers and flow-promoting agents to produce a free flowing product. Of course, to maintain both heavy duty and light duty products readily available for use the consumer must purchase both formulations. Additionally, if it is desired to utilize a bleaching effect during the washing operation, as by the incorporation of sodium perborate or percarbonate in the detergent, still another type of product must be purchased. Even by such purchases it is not possible to vary the proportion of foam supressant or foam booster, germicide, bleaching agent, nonionic detergent, builder salt or active detergent ingredient, without purchasing still additional boxes of different formulations.

Detergent tablets have been marketed for use in washing machines. Such products have been comparatively large, usually being about 5 centimeters in diameter and about 1.5 to 3 centimeters thick. They are more useful than detergent powders because they are nondusting and do not require measuring but they suffer from the same formulation disadvantages, i.e., their compositions are fixed. Smaller detergent tablets have been sold for use in cleaning false teeth and such products have often included effervescing agents to promote dissolving thereof. These too, however, are of an established formulation, which is not conveniently modifiable. Liquid and powdered detergent components such as bleaches have been marketed in envelopes, packets, capsules or other containers for optional addition to the washing machine with detergent, if desired, and in some cases water soluble packaging, such as that made of polyvinyl alcohol-vinyl acetate copolymers or mixtures has been used. However, such bleaches were not marketed as parts of "separate component" formulations of detergents and were intended for addition to prepared detergent compositions when the need arose.

In short, the art has not been aware of the present inventor's major inventive concept, that components of detergent compositions should be separately tableted or produced in convenient units so that the consumer, following the manufacturers' instructions, can formulate her own detergent composition so as to make it most suitable for washing the particular laundry at hand. In the preferred readily dispensed tablet, envelope, packet or capsule forms, the present units are readily packaged, filled into a dispensing article, dispensed and used without the need for the consumer to purchase a large number of different formulations. The use the different detergent composition components allows sequential additions of these to the washing machine in those instances where this is preferable. Also, because tablets can often be made with materials that would be too sticky to spray dry satisfactorily, lesser quantities of filler salt or carrier may be utilized. Significant energy savings result since it is not necessary to dissolve the detergent composition components in water and then remove the water from them by spray drying to obtain the desired physical forms thereof and spraying problems, such as pluming of nonionic detergent components, are avoided. Raw materials, such as sodium sulfate filler (which may be in short supply), used to assist in spray drying, may be omitted and tablet weights may be decreased accordingly. Shipping costs may be lowered significantly since both product weight and volume can be lowered. This allows decreasing package size which may assist in obtaining supermarket shelf space for the product. Also, tablet production and inventory control are easier and a central plant may produce an inventory of tablets which can be formulated into a variety of products, e.g., phosphate and non-phosphate detergents. Of course, the use of the tablets is very convenient. They are non-dusting, of small volume and easy to store and best of all, they conveniently allow the formulations of detergents which do the best washing job.

In short, the art has not been aware of one of the most important of the present inventive concepts, that components of detergent compositions should be separately tabletted so that the housewife could, following manufacturers' instructions, formulate her own optimized detergent composition which would be most suitable for washing the particular laundry at hand, and yet, would be able to be formulated into various other detergent compositions. In the preferred readily dispensed tablet, capsule or packet forms, the present units are readily packaged, filled into a dispensing article, dispensed and used without the need for the consumer to purchase a large number of different formulations.

In accordance with the present invention there is provided a detergent composition comprising separate units of components thereof, each of which is of such size that simple multiples of such units, in the range of 1 to 10 of each thereof, are present in the composition and produce, when dissolved in water, from 20 to 80 liters of effective washing or laundering solution. Preferably the detergent composition components are in tablet form, including a synthetic organic detergent in one tablet, a builder in another tablet and an adjuvant or additional components selected from the group consisting of a different synthetic organic detergent, bleaching agent, anti-redeposition agent, foaming agent, antifoaming agent, optical dye, bactericide, fungicide, emollient, corrosion preventive compound, antioxidant, stabilizer, hydrotrope, enzyme, solvent, sequestrant, softener and antistatic agent. Although it is possible to utilize as units of components of the compositions packets or capsules of powders or liquids, it is preferred that all components be so formulated as to be tabletable and be used in tablet form, preferably with inclusion therein of an effervescing or break-up agent to facilitate disintegration of the tablet in water and to promote dissolving thereof. Also within the invention are built detergents of the present tablets or units, packages of tablets or units of components, articles for dispensing such tablets or units and methods of utilizing them in the washing of laundry.

The invention will be readily understood by reference to the following description thereof, taken in conjunction with the drawing in which.

Figure 1:
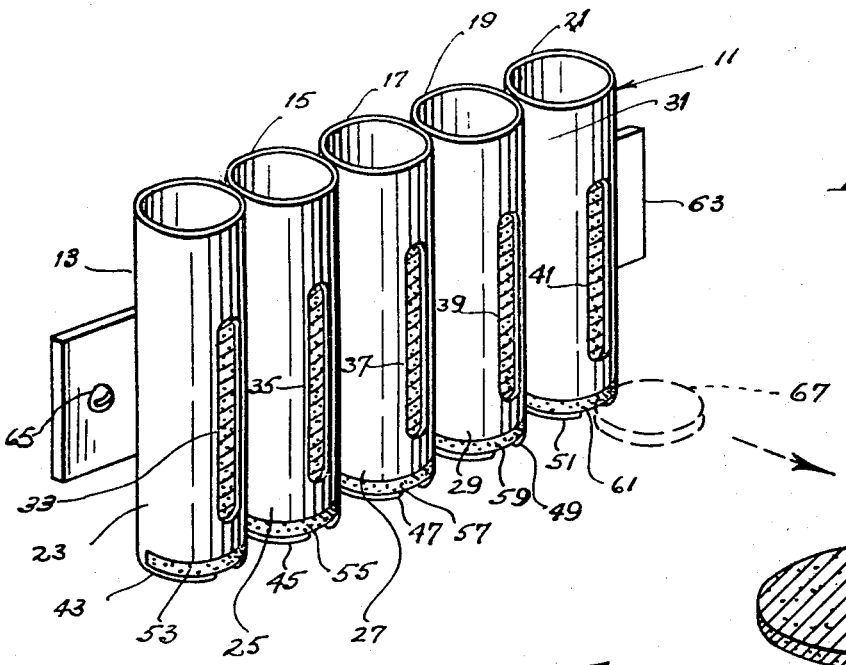
FIG. 1 is a perspective view of a dispensing article for dispensing a plurality of units of detergent components, affixable to or near a washing machine.

In FIG. 1 holder 11 includes cylindrical tubes 13, 15, 17, 19 and 21, all of which are illustrated as having open tops (although covers may be provided), cylindrical side walls 23, 25, 27, 29 and 31, viewing openings 33, 35, 37, 39, 41, arcuate bottom supports 43, 45, 47, 49 and 51, slits or transverse openings at the bottoms of the cylinders through which tablets 53, 55, 57, 59 and 61 are withdrawable transversely and mounting means 63, having a mounting hole 65 therein. Such means may be fastened to a wall, as by screwing onto the wall using mounting means such as hole 65 or may be welded onto the washing machine side or a top back panel thereof for ease of dispensing. Preferably, a magnetic mounting is used, e.g., a permanent magnet embedded in holder 11 or mounting means 63, or a pressure-sensitive adhesive, as on mounting means 63 or on a tape coated on one or both sides thereof is used. The tubes 13, 15, 17, 19 and 21 may be separate or may be unitary, e.g., of molded plastic, such as clear or tinted polystyrene. To remove a tablet it is a simple matter to place a finger under the bottom tablet of a tube and, pulling the finger forwardly through the opening in arcuate bottom support 51, frictionally contacting the tablet and moving it forwardly too, to a position like that illustrated at 67, passing bottom support 51 and being released.

Figure 2:
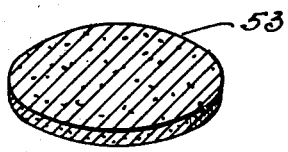
FIG. 2 is a perspective view of a tablet of builder salt, color coded to identify it.
Figure 3:
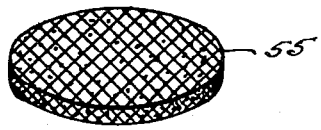
FIG. 3 is a perspective view of a tablet of anionic synthetic organic detergent, colored differently from the builder to identify it.
Figure 4:
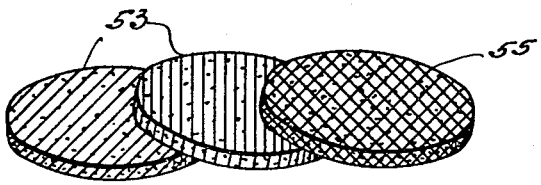
FIG. 4 is a detergent composition consisting of one tablet of synthetic organic detergent and two tablets of builder salt, suitable for washing a load of laundry in an ordinary automatic washing machine.

In FIG. 2 numeral 53 represents a tabletted builder salt and in FIG. 3 numeral 55 represents a tabletted anionic synthetic organic detergent active ingredient. In FIG. 4 a mixture of two of the builder tablets 53 and one of the detergent tablets 55 is shown, which mixture is ready to be used as a built detergent composition for washing laundry in an automatic washing machine.

Tubes 13, 15, 17, 19 and 21, although illustrated in the same cylindrical shape, can be of other tubular shapes and can be of different tubular shapes, each adapted to hold and dispense tablets or detergent component units of identifying shapes or markings. Similarly, each tube can be color coded to match the color of a detergent component charged to it. Thus, tube 13, which holds builder salt tablets, may be white to match the color of such tablets, tube 15 may be yellow, color code identified with the active ingredient tablets of the same color, tube 17 may be green, matching the color of oxidizing or bleaching agent tablets, tube 19 may be pink, the color of emollient or softening ingredient tablets contained therein and tube 21 may be blue to match the tablets of anti-redeposition agent and other adjuvant materials employed. Of course, the matchings may be by other coding means identifying the containers with the tablets, such as indentations in the tablets, letters thereon, speckled or spot colors, etc., and similar markings will be on the tubes. The number of tubes illustrated, five, is a preferred number. Usually the number thereof will be from 2 to 10, preferably 2 to 5 and more preferably from 3 to 5. In some cases, as where a preponderance of one material is preferably employed it may be desirable to have two of the tubes or dispensers used for the storage of a single material. Similarly, for ease of formulation, score marks may be provided so that lesser quantities of some tabletted components may be employed. The various tubes used may be covered and they may be inside a covering unit, designed to protect hygroscopic materials from absorbing excessive amounts of water. Alternatively, the bottoms of the tubes may be provided with closures to cover the portions of the tablets that would normally be exposed during use and similarly, the side openings may be covered. Various other designs of plural dispensers may also be employed. The tubes may be removably fastened to the holder by slip-in tapered joinder means or other suitable fasteners, not illustrated. Excessively hygroscopic materials may be coated after pressing, as with water soluble resin coatings, to prevent any undesirable moisture absorption by them and consequent mushiness. However, in most cases the formulation of the tablet or unit will be such that special coatings will be unnecessary.

The various detergent components that may be employed have been described in a host of patents relating to detergent powders, especially spray dried granules. The same materials as are used in such compositions may be employed in the present tablets or units. Thus, the synthetic detergents, both anionic and nonionic, builders, especially builder salts, anti-redeposition agents, enzymes, softening compounds, flow promoting agents (useful in assisting in tabletting), envelope- or capsule-forming materials, bleaches, oxidizing agents, corrosion preventives and various others of the adjuvants already referred to above, which are also described in the patents, may be used. Such materials are recited in U.S. Pat. Nos. 3,240,712; 3,247,122; 3,346,502; 3,528,921; 3,634,260; 3,676,199; 3,696,034; 3,698,095; 3,748,093; 3,755,201; 3,772,901; and 3,798,181, all of which are incorporated herein by reference so as to avoid an unduly lengthy description of such materials. However, a comparatively short description of useful components will be given herein.

Detergent compositions that may be prepared by the method of this invention in unit or tablet component form normally include a synthetic organic detergent component, such as an anionic detergent based on a sulfated or sulfonated lipophilic group containing a higher alkyl group, preferably higher linear alkyl, of 10 or 12 to 18 carbon atoms. In this specification, such sulfated and sulfonated materials may be referred to generically as "sulf(on)ated". These will usually be employed as alkali metal salts, preferably sodium salts, but may sometimes also be used as other water soluble salts, e.g., salts of potassium, magnesium, ammonium, mono-, di- and tri-lower alkyl amines and mono-, di- and tri-lower alkanolamines, each of the alkyl and alkanol groups thereof having from 1 to 4 carbon atoms. The sulf(on)ated anionic detergents include the linear alkyl aryl sulfonates, such as the sodium higher alkyl benzene sulfonates and the sodium higher alkyl toluene sulfonates; the higher alkyl sulfates, e.g., sodium lauryl sulfate, sodium coconut oil fatty alcohol sulfate, sodium oleyl sulfate; the sodium salts of N-methyl taurine amides, e.g., Igepon T; the water soluble sodium and potassium salts of esters of isethionic acid; higher fatty acid monoglyceride sulfates and sulfonates, e.g., coconut oil fatty acid monoglyceride sulfate, sodium salt; paraffin sulfonates; higher linear alpha-olefin sulfonates, e.g., hydroxyalkane sulfonates and alkenyl sulfonates, including mixtures of long chain ($C_{12}$–18) alkenyl sulfonates, sodium salts and long chain hydroxyalkano sulfonates, sodium salts; higher alkyl ethoxamer sulfates and methoxy-higher alkyl sulfates, such as those of the formulas $RO(C_2H_4O)_nSO_3M$, wherein R is a fatty alkyl of 10 or 12 to 18 carbon atoms, n is 2 to 6 and M is a solubilizing, salt-forming cation, such as alkali metal, ammonium, amines and alkanolamines previously mentioned, and

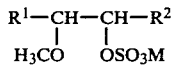

wherein $R^1$ and $R^2$ are selected from the group consisting of hydrogen and alkyls, with the total number of carbon atoms in $R^1$ and $R^2$ being in the range of 10 to 18. For both types of the alkoxamer sulfate detergents mentioned the preferred compounds are those in which R is about 14 to 15 and the sum of $R^1$ and $R^2$ is about the same.

Other descriptions of the anionic synthetic organic detergents may be found in patent applications Ser. Nos. 255,356; 255,357; and 255,358 of Paul S. Grand, filed in the U.S. Patent Office on May 22, 1972, the disclosures of which are hereby incorporated by reference. These applications also describe various other components of the present formulations, including builder salts, nonionic detergent components, anti-redeposition agents and other adjuvants and give formulas for suitable detergent compositions including such materials.

If desired, higher fatty acid soaps, such as alkali metal soaps of higher fatty acid or glyceride mixtures obtained from animal fats and vegetable oils of well-known soapmaking types, e.g., coconut oil and tallow mixtures of respective proportions from 10:90 to 50:50 may be used. The soaps have the desirable property of hardening some of the softer and more hygroscopic components of the present tablets and may be used together with anionic active ingredient, anti-redeposition agent or perfume or other adjuvant materials, to produce desirable tablets. They are also useful in controlling the foaming of the detergent product. In preferred embodiments of the invention a nonionic detergent will contain from 10 to 24 carbon atoms in the lipophilic portion thereof, from 10 to 18 of which will usually be in an alkyl group, preferably a linear alkyl. Such alkyl may be joined to an aryl, such as a phenyl, toluyl or xylyl group, but is preferably the sole lipophilic portion of the detergent molecule. In most preferred embodiments, the nonionic detergent will include a linear alkyl lipophilic moiety which is unsubstituted and which contains an average of from 12 to 15 carbon atoms, sometimes preferably averaging 14 to 15 carbon atoms. Generally, preferred alkyls will have their carbon atom contents in the narrow ranges previously mentioned for the average, with some extensions beyond these. Thus, from 10 to 18 carbon atoms may be in the higher alkyl or alkoxy portion of the molecules, preferably from 12 to 16 carbon atoms. In the poly-lower alkoxy moiety, the extent of its hydrophilic nature may be regulated by including some polypropoxy groups but these will generally be limited in number to less than $\frac{1}{3}$ the number of ethoxy groups because the propoxies, when formed into a chain, are usually lipophilic. Preferably, the chain will be entirely polyethoxy and from 4 to 40 carbon atoms will be present in such poly-lower alkoxy chain, preferably 6 to 30 carbon atoms and more preferably 14 to 22 carbon atoms. Such compounds are available commercially under the trade names Neodol 45–11, Plurafac B-26, Alfonic 1618–65 and Neodol 25–7.

Although not as preferable as the other nonionics already mentioned for the manufacture of the present detergent products, various other nonionic detergents used are as described in the texts *Surface Active Agents and Detergents,* Vol. II, by Schwarz, Perry and Berch, published in 1958 by Interscience Publishers, Inc., and *Detergents and Emulsifiers,* 1969 Annual by John W. McCutcheon. Among such nonionic compounds are the higher alkyl phenoxy poly-lower alkoxy lower alkanols, e.g., nonyl phenoxy polyethoxy ethanol (Igepal CO-880) and balanced hydrophilic-lipophilic compounds made by the condensation, either random or block, of hydrophilic lower polyalkylene oxides or lower alkylene oxides (ethylene oxide) with lipophilic lower polyalkylene oxide or lower alkylene oxides (propylene oxide). Thus block copolymers of ethylene oxide and propylene oxide, e.g., Pluronics ®F-68 and L-44 may be used or heteric polymers of ethylene oxide propylene oxide and $C_1$–$C_8$ alkanols such as butanol, e.g., Ucons ®, may be used. The lower alkylene oxides employed are of two or three carbon atoms and the nonionic detergents that are useful may contain from 4 to 100 mols of lower alkylene oxides per mol of compound. Of course, it is usually preferred to employ the normally solid nonionic materials, rather than the liquids, with which special carriers may be needed for tabletting or which may have to be encapsulated, as by freezing, coating and thawing or other suitable capsulizing technique.

Although not usually considered to be desirable detergent materials in the present products, in the absence of anionic detergent there may be utilized synthetic organic cationic detersive materials, such as the quaternary ammonium halides and amphoteric materials, such as the Miranols ®, may be employed, even in the presence of either anionic or cationic compounds, sometimes with nonionics also in the formulations. Lists of other suitable types of cationic and amphoteric compounds are found in the cited references.

The builder salt for the anionic, nonionic or mixed synthetic organic detergent is preferably an inorganic silicate or a mixture of such silicates, used with or replaced by other inorganic builders such as the phosphates, e.g., pentasodium tripolyphosphate, tetrasodium pyrophosphate; the carbonates, e.g., sodium carbonate;

sodium tetraborate; or an organic builder such as the nitrilotriacetates, hydroxyethyl iminodiacetates and ethylene diamine tetraacetates, all preferably as the sodium or potassium salts. In some compositions the proportions of phosphates, carbonates and nitrilotriacetates will be held to minima so as to comply with requirements for minimum phosphates, etc., to avoid alleged eutrophication effects and to promote safety of the product. In such instances, the contents of these materials will normally be less than 5%, preferably less than 2% and most preferably will be 0% of the product. The organic builders mentioned will also often be avoided to comply with government restrictions but, if and when those restrictions are lifted, building quantities of these salts, especially the nitrilotriacetates, may be employed. Thus, because of the separate components of the present products the manufacturer can ship from a central plant or warehouse various formulations suitable and legal for use in the different states and municipalities which have passed legistation controlling detergent formulations.

Of the silicates and other builders the water soluble alkali metal salts, such as those of sodium and potassium are preferable and, although wide varieties of ratios of $M_2O:SiO_2$, wherein M is alkali metal, have been employed, the preferred building silicates which are not objectionably alkaline are those wherein $M_2O:SiO_2$ is between about 1:1.6 and 1:3, preferably from 1:2 to 1:2.7, most preferably about 1:2.3 or 1:2.4, e.g., 1:2.35.

In addition to builder salts, filler compounds, preferably inorganic salts such as the water soluble alkali metal sulfates and chlorides, e.g., sodium sulfate, sodium chloride, sodium bisulfate, either as anhydrous salts or as hydrates, may be used, preferably in anhydrous forms. Fillers may be included in these formulas because they are impurities or byproducts in the anionic detergents but generally they will not be added to the present formulations because they contribute little or no desirable washing properties.

Soil anti-redeposition agents of the synthetic or natural gum type, such as polyvinyl alcohol, sodium carboxymethyl cellulose, hydroxypropyl methyl cellulose, methyl cellulose, sodium alginate, polyvinyl pyrrolidone or locust bean gum may be utilized. Among the various other adjuvants used the bleaching agents will normally be perborates, such as sodium perborate, or the corresponding sodium percarbonate, or a chlorine-generating bleach, such as dichlorodimethyl hydantoin, dichlorocyanuric acid, sodium or potassium salt or trichlorocyanuric acid, sodium or potassium salt, or others described in the cited references. The foaming agent will usually be an alkanolamide, such as higher ($C_8$–$C_{18}$) fatty acid mono-lower or di-lower alkanolamide, e.g., lauric myristic diethanolamide. Useful antifoaming agents include soaps and nonionic detergents, already described. Among useful bactericides are hexachlorophene, tetrachlorosalicylanilide and bromochorosalicylanilides and the useful fungicides include phenolic compounds, sodium undecylenate and mercury compounds. Among the emollients those preferred are the higher fatty acids and among the corrosion preventive compounds silicates are preferably employed, which also have a building effect. Antioxidants include conventional reducing agents and preferentially oxidized materials and stabilizers include stannous chloride. Among useful hydrotropes or solubilizers are sodium xylene sulfonate and sodium toluene sulfonate. Useful enzymes are proteolytic and amylotic enzymes, including protease, peptidase and amylase. Useful solvents, sometimes employed, include carbon tetrachloride and chloroform. A representative softening compound is lanolin or ethoxylated lanolin but cationic compounds such as di-$C_{14}$-$C_{18}$-alkyl dimethyl ammonium chlorides, are also useful and such quaternary compounds also function as antistatic agents.

Although it is preferred that each component be employed separately, this will often be most practicable for only the major components and it will often be desirable to mix together at least some of the various minor adjuvants. Of the major components the synthetic organic detergent (normally anionic) will usually be kept separate from the builder salt, although in some embodiments of the invention small proportions of these materials may be mixed together. Similarly, oxidizing agents such as sodium perborate or sodium percarbonate will usually be kept separate from the rest of the composition and may be specially treated, as by paraffin or resin coating, to prevent decomposition during storage when exposed to the moisture of the atmosphere.

A desired additional component of various tablets is an effervescing composition, such as a finely divided mixture of sodium bicarbonate and citric acid or other suitable acid, in approximately stoichiometric proportion, e.g., 21 parts of sodium bicarbonate and 16 parts of citric acid. It has been found that this mixture assists in the tabletting of the some of the tackier components, such as detergents and gums. Instead of citric acid, other organic acids may be employed, including gluconic acid, tartaric acid, lactic acid and inorganic acids such as boric acid, all of which are normally solids. Instead of sodium bicarbonate, other water soluble bicarbonates may also be utilized and it is within the invention to employ other gas-generating or effervescing compositions known in the art. In place of or together with the effervescent materials, there may be utilized break-up agents, which facilitate disintegration of the tablet in water to promote dissolving of it. Such agents include swelling agents, such as starch, polyvinyl pyrrolidone, clays, sugar and various materials which, when brought into contact with water, will tend to act to disrupt the normal tablet structure, allowing contact of more tablet surfaces with wash water, which promotes dissolving.

Of course, instead of tablets, packets, envelopes or capsules, other continer may be employed, wherein the materials thereof are water soluble film-forming compounds or polymers, e.g., polyvinyl alcohol, gelatin. The material of the packet or envelope may be useful as an anti-redeposition agent or a softening agent or for other purpose in the detergent composition, just as the citrate or gluconate produced from the effervescers may have sequestering properties which help to improve the activity of the detergent composition in the presence of hard waters.

The proportions of detergent composition constituents utilized will normally be such that 5 to 50% of the final detergent composition is detergent builder salt, preferably from 10 to 25% thereof, 1 to 15%; preferably 2 to 10% and more preferably 2 to 5% is nonionic detergent; 10 to 70%, preferably from 15 to 40%, is builder salt; 0 to 5%; preferably 0.5 to 5% and more preferably 1 to 3%, is a synthetic organic gum anti-redeposition agent, such as sodium carboxymethyl cellulose; 0 to 20%, preferably 1 to 10% is moisture; and 0.01 to 5%, preferably 0.1 to 2% of each of the other adjuvants or any part thereof is present, with the total of such adjuvants normally being no more than 20% and preferably being from 1 to 10%. The ratio of detergent to builder salt is normally in the range of 1:1 to 1:10 and preferably is 1:2 to 1:5, by weight. The above formula is of a heavy duty detergent and may be modified to produce other types of detergents. For example, when little or no builder tablet or builder is used, a light duty detergent is made, suitable for washing delicate laundry, personal care or dishwashing, in which latter cases, the use of adjuvant tablets may also be omitted, except for those containing emollients and bactericides. The tablets are sized so as to produce compositions in the above ranges when 1 to 10 of each are employed.

While it is desirable to maintain the tablet contents so that each of them consists essentially of a particular detergent composition component, the percentage of effervescing composition or break-up agent in a particular tablet may range from 0 to 95% and is preferably from 0.5 to 70% thereof. Nevertheless, such content will usually be kept as low as feasible and will be adjusted for each component.

The sizes of the tablets or units are such as to be readily dispensable, with weights generally being of 5 to 30 grams, preferably from 10 to 20 grams and with volumes of 4 to 20 milliliters, preferably from 7 to 15 milliliters. The tablets may be of various shapes but are preferably of flat cylindrical shape, with diameters of 1 to 4 centimeters, preferably 2 to 3 centimeters and thicknesses fron 0.3 to 2 centimeters, preferably from 0.3 to 0.8 centimeter. The use of such sizes, weights and shapes promotes ready solubility because of the large exposed surface area and tablet break-up characteristics, and allows the formulation of detergent compositions from the various tablet components by using simple multiples of tablets, in the range of from 1 to 10 of each, normally from from 1 to 5 detergent tablets, 2 to 10 builder tablets (when builders are employed), 1 to 3 bleach tablets and ½ to 2 of various other adjuvant tablets, 1 to 4 of such adjuvant tablets when a plurality of adjuvants is used.

The preferred tablet form of the invention is made by pressing together, preferably thoroughly blended with an effervescing or break-up of agent, finely divided powders of the various individual components. Where some of the constituents are somewhat tacky they may be pre-mixed with more free flowing materials. Usually the powders employed will be of diameters less than 140 mesh and preferably less than 200 mesh but in some cases coarser particles may be desirable. Pressures utilized for compacting may be from 3 to 100,000 lbs./sq. in., preferably 100 to 50,000 lbs./sq. in. and normally most preferably being in the 500 to 20,000 lbs./sq. in. range. Pressures will be modified to produce the best types of coherent tablets which will disintegrate rapidly in the washing machine. Normal tablet densities are from 0.8 to 2 g./ml., preferably 1 to 1.5 g./ml. During pressing dry release agents such as talcs, or silicones may be employed and these may be desirably incorporated in some formulations.

When instead of tablets, other containers such as envelopes, packets or capsules of powders or liquids are employed, the weights and sizes thereof will preferably be such as to approximate those of the tablets previously mentioned. The packets, capsules, etc., may be treated to make them resistant to the contents and to softening on exposure to atmospheric moisture. Normally, such packet, envelope or capsule materials will be water soluble but it is within the invention to employ water insoluble materials, too.

After pressing of the tablets or other formation of the units it is a simple matter to pack them, either mixed or separated, in a normal detergent box, preferably of the barrier or liner type. If the various tablets are mixed together, as is preferable for the lowest cost product, the consumer may select the specific tablets he wishes to use for a particular washing operation, adjusting the numbers of components in accordance with the type of wash and the manufacturer's instructions on the box. The numbers of component tablets present in the box will usually be such as to make the product most suitable for use as a heavy duty laundry detergent and since this is the most common use for a detergent compositions, there will usually be few builder tablets left over when the box is nearly consumed. Still, such tablets may be saved for future use. Also, particular component tablets may be sold separately for those consumers who have special washings problems or practices that result in excess tablets remaining from the box of heavy duty components. The present compositions may also be provided, as was previously mentioned, in separate containers within a larger package, with tubes or sleeves of each component tablet or unit packed together for easy addition to a dispenser. The components may also be maintained separate in separate compartments built into the detergent box. In some cases, the carton itself may function as a dispenser, having the various tablets or units in tubular holders therein and having means at the end of the carton, somewhat like those illustrated in FIG. 1 or performing a similar function, for retaining the tablets in the tubes except when it is intended to dispense them. If desired the "carton" may be a unitary container of clear plastic with dispensing means molded into it.

For washing laundry with the present tablets in an automatic laundry machine, their primary intended use, it is normally desirable to have the concentration of the composition used in the washing machine at from 0.05 to 0.5%, preferably from 0.1 to 0.3% and most preferably about 0.15%. Such concentrations are most applicable in United States washing practice whereas in European countries greater concentrations of the detergent compositions are usually employed. Also, such concentrations are based on the use of about equal parts of total normal detergent composition active components and disintegrating agent. When, as is often the case, little or no break-up agent is needed, the concentrations employed may be lowered accordingly and tablet or unit sizes, weights and volumes may also be reduced. Washing temperatures may be hot or cold, depending on the detergent formulation and the laundry being washed, normally being in the range from 30° to 90° C. in the United States, preferably from 45° to 70° C. Washing times run from one minute to one hour but generally will be from 15 to 45 minutes in an automatic cycle. Laundry loads will usually be from 4 to 12 lbs. per tub full of water, preferably from 6 to 10 lbs. and most preferably about 8 lbs. per tubful and the tubs will hold from 20 to 80 liters, preferably from 40 to 60 liters of water. The water employed is preferably soft or of a hardness less than 150 p.p.m., calculated as calcium carbonate.

In industrial laundering applications wherein large quantities of detergent are employed, for the usual heavy duty washing operations it may not be necessary to count the different tablets of detergent components.

In such operations, one may pour in the entire content of the box or so much of it as to statistically give an average heavy duty synthetic detergent composition. The box or container size may be changed to allow such single dispensing of the composition for particular washing applications. Of course, the individual tablets can be counted or weighed out, if desired. also, when it is wanted to vary the formulation, this is possible.

Charging of the detergent component tablets or units to the wash water may be controlled so as to advantageously charge one portion of the detergent composition before another. For example, builder salt may be charged before detergent so as to counteract hardness in the water and prevent precipitation out of anionic detergent by the hardness ions. Enzyme portions of the detergent composition may also be charged initially, as during the soak period, if desired. Acidic or basic components may be charged to regulate pH at particular times in the washing cycle and softener may be added after completion of the washing or during the washing, as desired. Due to the tabletting or unitizing of the various components there is apt to be less chemical or other interference between the components during storage, especially if they are inner wrapped separately in the marketing package. The particular shapes of the tablets, thin flat discs, facilitate easy break-up and promote solubility of the components. Thus, the advantages of the present compositions and packages containing them are apparent over prior art materials and at the same time the consumer has the right and the power to vary the detergent recipe, depending on her needs. For example, when different types of builders, as salts, are sold in the present packages, the housewife may be able to utilize non-phosphate builders for all but the most difficult washing, even in areas of the country where phosphates are allowed, thereby doing her share to prevent the discharge of excessive phosphates into inland streams. In short, custom detergent formulation is now available at the household level and the housewife has the right and the power to make independent decisions as to which detergent formulation she would like to use for each of different sets of washing conditions. She can do this conveniently, at minimum expense and can obtain best washing results, equal or superior to those obtained by the use of even excessive quantities of standard detergent compositions.

Although the present invention has been discussed primarily with respect to heavy duty detergent compositions consisting essentially of separate major tabletted components the underlying principle of this invention can be applied to other detergent compositions, so that the basic composition marketed, including separate components, can be a light duty detergent, a dishwashing detergent, a shampoo, an enzyme presoak, a fabric softening composition or a bleach, in all of which various solid or liquid components can be conveniently separately packaged for admixture together of premeasured amounts in accordance with manufacturer's instructions so as to obtain the most desired effects under particular operating conditions. Thus, some such compositions can be made with all of the component parts thereof separately packaged or packaged in subcombinations, as liquids (solutions or dispersions), powders or unitary solids. Preferably, such a liquid is a nonionic detergent, a perfume, an aqueous solution of detergent, builder salt or other component or a mixture thereof. Normally, however, perfume will be present in all of the tablets so as to increase the pleasant aroma of the product and all components employed.

The following examples illustrate but do not limit the invention. Unless otherwise mentioned, all parts are by weight and all temperatures are in °C.

EXAMPLE 1

| | Parts by Weight |
|---|---|
| Linear dodecyl benzene sulfonate, sodium salt | 15 |
| Sodium silicate ($Na_2O:SiO_2$ = 1:2.35) | 20 |
| $RO(CH_2CH_2O)_{10}CH_2CH_2OH$ (R = $C_{14}$ alkyl) | 5 |
| Sodium tallow-coco soap, anhydrous (tallow:coco = 90:10) | 5 |
| Sodium perborate | 15 |
| Perfume | 0.5 |

A detergent composition of the above formula, found to be an excellent detergent for washing heavily soiled laundry in an automatic washing machine, in areas of the country wherein phosphates are prohibited, is made by mixing together tablets of each of the individual components. The tablets are flat cylinders weighing about 20 grams each, measuring 4 cm. in diameter by 1.5 cm. thick and each contains about 50% of a stoichiometric mixture of sodium bicarbonate and citric acid, with about 10% of suitable tabletting starch present, too, the balance being of the detergent component. When it is desired to charge a 15 gallon automatic washing drum with about 90 grams of product which contains at most about 8 grams of active ingredient per tablet, about 12 tablets are used. The numbers of such tablets employed are as follows:

| | |
|---|---|
| Anionic | 3 |
| Silicate | 4 |
| Nonionic detergent | 1 |
| Soap | 1 |
| Perborate | 3 |

The perfume is equally distributed among the various tablets.

The tablets are dispensed from an ordinary barrier soap powder carton or clear plastic container wherein they are mixed together in the above 3:4:1:1:3 ratio. In some embodiments of the invention they are separately packaged in the detergent package or separated in compartments of the plastic container. In either case, the consumer fills a dispensing article like that of FIG. 1 with the tablets, which are color coded to match the dispensing tubes, the anionic detergent being yellow, the silicate being white, the nonionic detergent being blue, the soap being pink and the perborate being green.

To use the present composition, it is only necessary to remove four of the white tablets three each of the yellow and green tablets and one each of the pink and blue tablets and charge them to an automatic washing machine, which contains 15 gallons of water, at a temperature of about 65° C., for the washing of about 8 pounds of soiled laundry. After a 45 minute automatic wash cycle, the laundry is found to be satisfactorily cleaned.

In a variation of this experiment, the silicate and perborate components are removed from the formula and a mixture of three yellow tablets and one each of the pink and blue tablets is employed to wash a lightly soiled load of laundry in the same washing machine. The detergent is mild to the laundry and satisfactorily washes it, using water at 50° C. and a 20 minute wash cycle. In another variation the builder salt tablets are added to the wash water before the other components and it is noted that anionic detergent precipitation is decreased and no soap curd forms.

In another modification of this experiment an additional builder salt is tabletted by pressing sodium tripolyphosphate into similar sized tablets. Seven of such tablets are employed and the number of sodium silicate tablets is decreased to two from four. Since both types of tablets are white, the silicate tablets are marked with an S and the phosphate tablets with a P to facilitate identification. A detergent solution is formulated from the various tablets according to the method previously described and is found to be of excellent detegerent properties, preferable for use in locations where employment of phosphates is permitted.

In the above formulas, the addition of anti-redeposition agent, such as sodium carboxymethyl cellulose, further improves the detergent performance. The CMC is utilized to the extent of about 1% by weight in the various tablets, wherein it helps some of the powdery materials to cohere during pressing. Alternatively, one part of sodium carboxymethyl cellulose is formulated into a single CMC tablet, with the proportion of effervescing and break-up agents being increased accordingly. Such a tablet is then utilized with the other units, employing one tablet with the other numbers of units described, for heavy duty detergent applications at a 1% product concentration. Excellent washing results when the method previously described is employed.

In all the tablets described, the moisture content will be maintained as low as possible so as to prevent premature reaction of the gas-generating salt and powdered salt. In most cases the moisture content will be about 1% or less. In those tablet formulations wherein additional plasticizer or solvent is needed due to the limitation of moisture contents, small proportions of monoglycerides or diglycerides of higher fatty acids, higher fatty alcohols such as cetyl alcohol, nonionic surface active agents and solvents such as polyethoxy alkanols and polyethylene glycols may be added, usually being held to less than 1% of the final detergent composition. Such materials also serve to indicate the gas-releasing salt and the reactive acid, preventing premature reactions.

Of course, under the pressing conditions employed, which in the above cases involve the use of pressures of about 5,000–20,000 lbs./sq. in., utilizing a hydraulic press instead of a rotary tabletting machine, the formulations will be chosen to produce the most firm tablet which yet disintegrates rapidly upon being placed in water. Contents of plasticizer, effervescing materials, break-up agents, detergent formulation components, and combinations, which are tabletted together, will normally be modified so as to produce the best tablet characteristics and quickest dissolving.

EXAMPLE 2

In the formulation of Example 1 the linear dodecyl benzene sulfonate is replaced by ten parts of sodium linear tridecyl benzene sulfonate, the nonionic detergent is replaced by two parts of $C_{14-15}$ higher fatty alcohol polyethoxy ethanol (Neodol ®45-11), the proportion of soap is reduced to two parts by weight and the soap utilized is sodium tallow soap, the sodium silicate content is dropped to nine parts and sodium tripolyphosphate is utilized, to the extent of 33 parts. This formulation is made like that described in Example 1, and proportions being so modified as to produce essentially the same size tablets. The product is an excellent washing composition and when heavily soiled laundry is washed in an automatic washing machine for 45 minutes at a temperature of about 60° C., the laundry is cleaned satisfactorily. Such results are also obtained when the ten parts of linear tridecyl benzene sulfonate are replaced with a mixture of 6.7 parts of such sulfonate and 3.3 parts of sodium alpha-olefin sulfonate wherein the olefin is a higher olefin. Tablets of such materials are dispensed, formulated into this optimized detergent composition and used by the washing method described and are found to be excellent cleaning agents.

In a variation of this experiment the number of tablets of phosphate employed is diminished because the effervescing and break-up agents utilized are cut to ¼ the normal amounts, allowing replacement of a proportion thereof with the active tripolyphosphate. Thus, instead of using seven tablets of tripolyphosphate 3 to 4 may be employed. In a similar manner greater concentrations of the other components may also be tabletted, by diminishing the proportions of effervescing agents or other unnecessary constituents in the tablets. In such cases the washing effects are just as good as when large quantities of effervescing mixture, break-up agent, filler or other material are present.

In the above reported experiments essentially the same results are obtained when the linear alkyl benzene sulfonate and alpha-olefin sulfonate detergent salts are replaced by corresponding potassium salt and when similar replacements are made of the silicate and phosphate constituents.

The heavy duty detergent composition is modified to a light duty product by omitting the pentasodium tripolyphosphate (or corresponding potassium salt) builder. In another application it is made more adaptable for extremely heavy duty applications such as floor cleaning, by increasing the number of tripolyphosphate tablets to 10. In further variations of these formulas, the following materials, on a formula basis, are combined into a single tablet and are charged to the wash water with the other mentioned tablets: 0.01 part silicone anti-foam; 0.2 part tetrachlorosalicylanilide; 0.2 part phenolic fungicide (Dowicide A ®); 1 part lanolin; 1 part sodium xylene sulfonate; 1 part proteolytic enzyme (Maxatase ®); 2 parts propylene glycol; one part hydroxyethyl iminodiacetate, sodium salt and 1 part dilauryl dimethyl ammonium chloride. One such tablet is utilized with the other mentioned tablets of the various formulations to impart the adjuvant effects to the product. The quaternary softener and anti-static agent may be separately tabletted, for addition to the rinse water after completion of washing or it may be included with the other materials and added as part of the washing composition, although in such case it will be somewhat diminished in effectiveness.

EXAMPLE 3

Tablets are made according to the method of Examples 1 and 2 separately comprising 9 to 15 parts of sodium tridecyl benzene sulfonate, 1 to 4 parts of nonionic detergent (Plurafac B-26 ®), 0 to 3 parts of sodium soap of tallow fatty acids with about 33 parts of sodium tripolyphosphate, 2 parts of sodium carboxymethyl cellulose and 9 parts of sodium silicate ($Na_2O:SiO_2$ ratio of 1:2.35). The nonionic is mixed with sodium bicarbonate and such mix is then compounded with powdered citric acid and tabletted. The other components are similarly tabletted with effervescing agent mixture except for the tripolyphosphate which is blended with about 5% thereof of starch and is then pressed to tablet form. In a variation of this experiment, all the materials are packaged in polyvinyl alcohol-polyvinyl acetate copolymer water soluble thin film (four mils thick) packets, readily disintegrable paper envelopes, gelatin capsules and in some cases, only the liquid or tacky components are so packed. In all such instances when added to the wash water, the products made are of excellent heavy duty detergency, with the polyvinyl alcohol-polyvinyl acetate copolymer and gelatin apparently improving anti-redeposition and other colloidal properties of the wash water. In another modification of the experiment, optical brightener components (0.2 Phorwhite BHC and 1% Tinopal RBS) are separately tabletted, with effervescing agent, and are employed or omitted as the consumer wants more or less fluorescent brightening of the laundry.

In this example and the preceding example, as in Example 1, when the builder salt tablets or other units are omitted from the wash water, the effect is to convert the product to a light duty detergent. Similarly, by intentional omission of other components, the detergent composition properties are varied.

The formulas of this example are packaged in cardboard dispensing cartons or plastic containers, wherein they are either intermixed or separately compartmented. In either case, the tablets are easily transferable and are transferred to a dispensing device such as that of FIG. 1 or are dispensed from the marketing contaier. In some instances, as when large industrial washing machines are utilized, the container may be so sized that the entire contents thereof are used in one wash but, if light duty washing is desired (or non-bleaching wash or "non-adjuvant washing") the unwanted constituent tablets or units are removed and washing is done with the remainder of the formulation only.

EXAMPLE 4

No-phosphate detergent tablets of the types and sizes described in Example 1 are made with the detergent formula changed to 21 parts sodium dodecyl benzene sulfonate, 4 parts nonionic detergent (Neodol 45-11), 4 parts sodium tallow soap, 1 part borax and 25 parts sodium silicate of an $Na_2O:SiO_2$ ratio of 1:2, each in a separate tablet, with 1 part of sodium carboxymethyl cellulose distributed among the tablets and with ½ parts of perfume and 1 part of a standard fluorescent brightener mix similarly distributed. The product is used in the same manner as described in Example 1 and is an excellent non-phosphate detergent. Such is also the result when the formula is varied to include from 18 to 23 parts of the anionic detergent, 2 to 6 parts of nonionic detergent, 2 to 6 parts of soap and 20 to 20 parts of silicate. When the nonionic is omitted detergency is diminished but the product is still an acceptable detergent. When the silicate is omitted the detergent is better for light duty applications, in which the borax is also usually omitted. When the specific adjuvants mentioned in the preceding specification are also tabletted and included in the formula in proportions in the mentioned ranges, usually at the midpoints of said ranges, the adjuvants effects thereof are contributed to the formulas, with or without builder salt being present. The total of said adjuvants will be less than 10% and the proportion of each will be held to about 0.1 to 1 parts or %.

In a variation of this experiment, when the tablet sizes are changed to have the tablets contain 10 and 25 grams of detergent composition components each, using the same hydraulic press tabletting pressures and dwells in the press of from 0.1 to 2 seconds at pressures of 1,000 to 30,000 lbs./sq. in. good disintegrable tablets result. This is also the case when sodium or potassium bicarbonate—gluconic or bicarbonate-tartaric acid mixtures are employed to generate the breakup gas and when from 2 to 10% of tabletting starch are employed in the formula.

EXAMPLE 5

A no-phosphate soap-based detergent composition is made of the formula: 55 parts of 85:10 tallow-coconut oil soap, 12 parts of sodium silicate ($Na_2OiSiO_2$=1:2.4), 12 parts of sodium carbonate and 5 parts of NaCl, with or without 1 part of sodium carboxymethyl cellulose, as a binder and anti-redeposition agent, with the builder salts in one tablet and the other ingredients in another tablet. When the builder tablets are employed in numbers less than 30 with the base tablet a good built detergent results and when the builder tablets are omitted a light duty detergent results. When the proportion of builder tablets is doubled a stronger built detergent is produced, suitable for extra-heavy duty applications.

In other experiments monoglyceride sulfate detergent tablets are made, with and without supplementing tablets of tripolyphosphate builder salt in 1:2 proportion. The monoglyceride sulfate, based on coconut oil fatty acids monoglyceride, sodium salt is somewhat tacky to tabletize and processing is facilitated by dissolving it and the same weight of sodium bicarbonate—citric acid stoichiometric mixture (dispersed) with tabletting starch (1/5 part) in ethanol to make a slurry which is then dried and powdered and pressed. The product made is a good component tablet of a detergent composition. The builder salt (STPP) is tablettable without such special treatment and only 5% of tabletting starch and a small proportion of soap is narmally employed with it to form good tablets.

The present invention provides tablets or other units, with or without effervescing or other breakup agents, to make a wide variety of detergent compositions, from personal care detergents to floor cleaners. It avoids the use of unnecessary and sometimes ecologically damaging detergent components, normally employed in detergents for processing advantages only. It may enable the manufacturer to use detegeent chemicals presently being rejected as unsuited for spray drying or other previously required processing steps. It makes an ideal convenience product for laundromat dispensing or campsite use and allows the consumer to take only a few tablets with her to the laundry, rather than a large box.

Of course, variations in the described formulas may be made and, if desired, more than ten of one tablet type can be used, or less than 1 but usually the main advantages of the invention are obtained within those ranges previously given. With the present teaching in front of him the expert in the art will be able to think of other adaptations of the invention to other detergent products and processes. Accordingly, the invention is not to be limited to the specific examples or teachings given but is considered to be encompassing of equivalents and substitutes that would be apparent to one of skill in the art which do not transcend the inventive concept.

What is claimed is:

1. A dispensing article for dispensing a detergent composition in the form of a plurality of separate units of at least two different detergent composition components as selected by the operator to produce an efficient washing composition for the type of laundry being washed in the washing machine which comprises a holder which holds from 2 to 10 receptacles for storing and dispensing a plurality of separate units of the detergent composition components with units of only one detergent composition component being present in each receptacle, each said receptacle being a vertical tube having a filling opening at the top, retaining means at the bottom, viewing openings or a transparent section therein through which the unit contents of the receptacle may be viewed, wall sections at the lower end of the tube defining an opening through which units can be removed transversely, one by one, as desired and being sized to dispense units each having a weight of 5 to 30 grams, a volume of 4 to 20 milliliters and a density of 0.8 to 2 g./ml; means on a wall of each receptacle for attachment of said receptacle to said holder; said means being adapted to be readily removable from said holder; and means for fastening the holder to a wall or to a washing machine in a convenient location for dispensing.

2. A dispensing article according to claim 1 wherein the said retaining means has an opening therein whereby the user's finger may frictionally contact the bottom unit and move it forwardly through said opening to remove the unit from its receptacle.

3. A dispensing article according to claim 1 wherein the units of each detergent composition component are color-identified and the receptacles for storing and dispensing said detergent composition component are color identified to match the color of said component.

* * * * *